United States Patent [19]

Genn et al.

[11] 4,083,456

[45] Apr. 11, 1978

[54] TERRACED MODULAR RACK ASSEMBLY

[75] Inventors: John P. Genn, Staten Island; Ralph M. Verni, Baldwin; Jonathan K. Bindman, Roslyn Heights, all of N.Y.

[73] Assignee: Controlled Sheet Music Service, Inc., Copiague, N.Y.

[21] Appl. No.: 662,465

[22] Filed: Mar. 1, 1976

[51] Int. Cl.[2] ..... A47F 7/00

[52] U.S. Cl. ..... 211/55; 211/128

[58] Field of Search ..... 211/55, 56, 88, 129, 211/130, 128, 189; 206/73; 220/307; 40/124.2; 248/224, 223

[56] References Cited

U.S. PATENT DOCUMENTS

| | | | |
|---|---|---|---|
| 1,156,401 | 10/1915 | Hawley | 40/124.2 |
| 1,587,935 | 6/1926 | Brunhoff | 211/128 |
| 2,880,262 | 3/1959 | Bell et al. | 220/307 X |
| 2,909,287 | 10/1959 | Galassi | 211/55 |
| 2,913,124 | 11/1959 | Rubenstein | 211/55 |
| 3,017,972 | 1/1962 | Saxe | 248/224 X |
| 3,390,806 | 7/1968 | Herbert | 220/307 |

*Primary Examiner*—Roy D. Frazier
*Assistant Examiner*—Robert W. Gibson, Jr.
*Attorney, Agent, or Firm*—Lackenbach, Lilling & Siegel

[57] ABSTRACT

A rack assembly includes a plurality of stacked rack elements adjacent ones of which are connectable to each other to form a terraced rack display. Each rack element is in the shape of a rectangular housing having bottom, rear and side walls. Male connecting members depend downwardly from the frontal portions of the bottom walls of each of the rack elements and are adapted to be snappingly inserted into mating female connecting members provided on the rear walls of co-operating rack elements. The mating female connecting members are spaced upwardly relative to the bottom walls on each rack element so that each succeeding or rearwardly disposed rack element is additionally upwardly elevated in the engaged conditions of the male and female connecting members. Additionally, inverted L-shaped planar female openings are provided in each of the side walls for receiving similarly shaped or inverted L-shaped planar male members. The L-shaped female openings are oversized and readily receive the L-shaped male members in a first initial position of two adjacent or back-to-back rack elements, the planar female openings being provided with an inclined edge or a surface which draws the two adjacent rack elements into close abutment when the elements are moved longitudinally relative to each other from the initial to the engaged locked condition of the L-shaped planar members within the associated planar female openings.

20 Claims, 8 Drawing Figures

FIG. 6
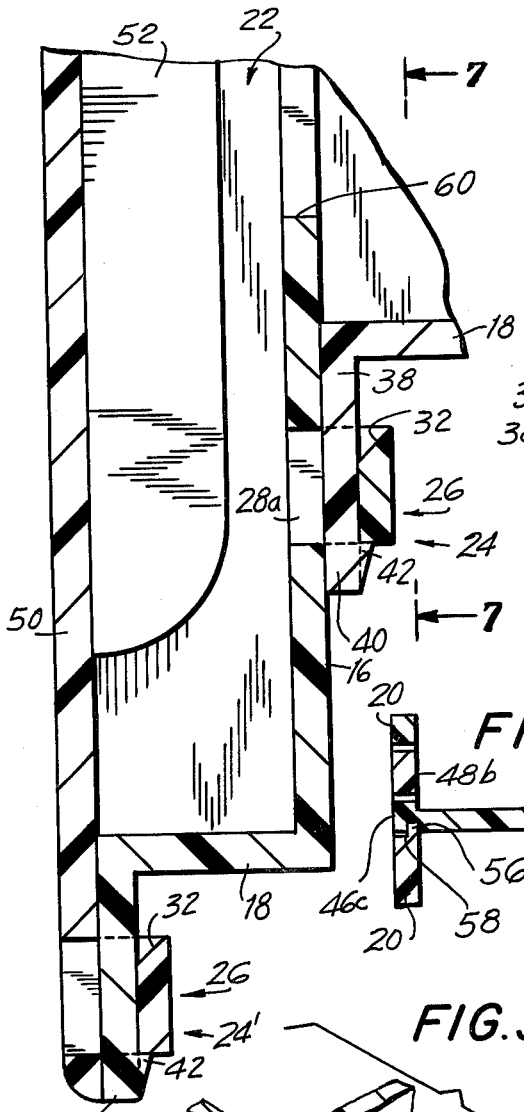
FIG. 7
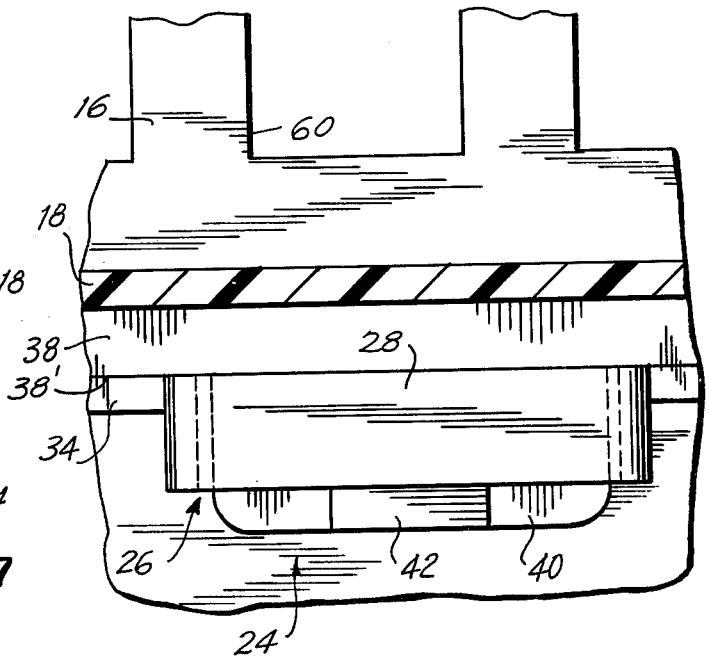
FIG. 4
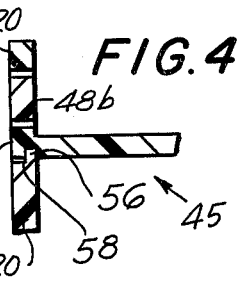
FIG. 3
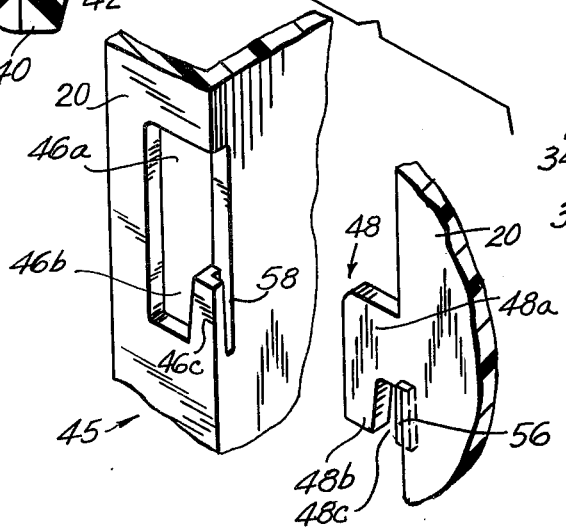
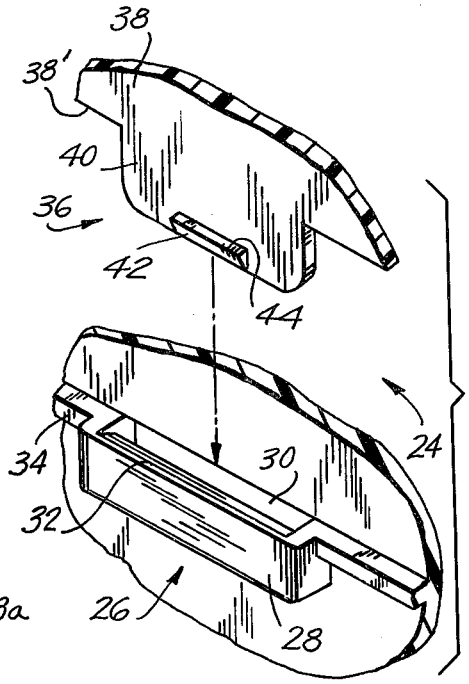
FIG. 8

TERRACED MODULAR RACK ASSEMBLY

BACKGROUND OF THE INVENTION

The present invention generally relates to display devices, and more specifically to a terraced modular rack assembly suitable for sheet music and the like.

Magazine racks and card racks of various types are already known. For example, U.S. Pat. No. 2,303,971 discloses a rack for cards and method of making the same. The rack has a plurality of pockets, spaces or bins in which cards or other articles may be removably placed. However, the known racks of this type, as evidenced by this patent, do not lend themselves to a modular construction wherein the size of the overall rack may be adjustably varied to form a rack with as many or as few pockets as desired. Additionally, various stationery racks and filing devices, generally disposed within draws of a desk, are similarly known, and some of these constructions are shown in U.S. Pat. Nos. 1,449,177 and 2,873,860. An examination of these patents reveals rather complicated constructions which are not suitable for the use intended by the present invention, the displaying of generally flat items, such as sheet music, magazines and the like. The stationery racks or filing devices above-mentioned are generally made out of metal, are complex in construction and expensive to manufacture.

Storage bin assemblies are also known for holding small articles. Such bin assemblies which have a detachable back support member to permit several similar bins to be stacked in a vertical way is known and described in U.S. Pat. Nos. 3,563,394 and 3,606,949. The bin assemblies of these patents are similarly complex in construction and expensive to manufacture. The storage bins of these patents, as well as the extruded display rack riser disclosed in U.S. Pat. No. 3,198,340 generally require various hardware in addition to the bin elements in order to securely interconnect the bins to each other. The prior art devices, accordingly, do not disclose a simple construction wherein simple molded units or housings form rack elements which are interconnectable with one another and which require no additional hardware of any type to securely connect the rack elements to each other and which permit ready changes in the size of the rack assembly by either increasing or decreasing the total number of rack elements to the desired number.

SUMMARY OF THE INVENTION

Accordingly, it is an object of the present invention to provide a rack assembly which does not have the above-described disadvantages associated with the prior art rack.

It is another object of the present invention to provide a rack assembly of the type under discussion which is simple in construction and economical to manufacture.

It is still another object of the present invention to provide a rack assembly which is suitable for storing and displaying sheet music and the like.

It is yet another object of the present invention to provide a rack assembly of the type under consideration which is modular in construction and permits easy assembly as well as changes in the total size of the assembly by increasing or decreasing the number of rack elements forming the assembly.

It is a further object of the present invention to provide a rack assembly which is stepped upwardly and rearwardly or terraced when the adjacent rack elements are connected to one another.

It is still a further object of the present invention to provide a rack assembly as suggested in the above objects which is formed from molded rack elements and which includes two integrally formed and separate locking means, one of which is provided on the rear walls and the bottom walls of the rack element housings while the other locking means is formed in the planes of the side walls.

It is yet a further object of the present invention to provide a rack assembly formed of a plurality of stackable rack elements each having side walls and including locking means for locking adjacent racks which locking means is formed totally within the planes of the side walls and which include a key and keyway associated with each locking means to align the rack elements and to ensure good locking engagement between the same.

In order to achieve the above objects, as well as others which will become apparent hereafter, a rack assembly in accordance with the present invention comprises a plurality of rack elements connectable to each other to form a terraced rack display. Each rack element is generally in the nature of a rectangular housing having bottom, rear and side walls. Each element has first locking means including a first locking portion substantially in the plane of said rear wall and a second locking portion downwardly projecting from the frontal region of the said bottom wall. A first locking portion of a frontwardly disposed rack element is engageable with a second locking portion of an adjacent rearwardly disposed rack element. Said rack elements further have second locking means substantially in the planes of said side walls for aligning adjacent rack elements with one another and for securely fixing the positions of the connected rack elements relative to one another. Said first and second locking means are adapted to arrange successively rearwardly disposed rack elements respectively successively upwardly to provide an upwardly and rearwardly stepped or terraced modular rack assembly. The first and second locking means permit adjacent rack elements to be securely connected to one another.

BRIEF DESCRIPTION OF THE DRAWINGS

Further advantages of the invention will become apparent from the reading of the following specification describing a presently preferred embodiment of the invention. The specification is to be taken with the accompanying drawings in which:

FIG. 3 is an enlarged fragmented perspective view of one of the locking means from the side walls of the rack elements, shown prior to locking or assembly of the two adjacent rack elements and showing the details of the mating lock recess and the tab as well as the details of the guideway or keyway means for aligning the lock recess and tab within the plane of the sidewall;

FIG. 4 is a fragmented cross-sectional view of the rack assembly shown in FIG. 2, taken along line 4—4;

FIG. 6 is an enlarged vertical section of the lower portion of the rack assembly shown in FIG. 1, showing the manner in which a front cover plate is mounted on the front-most rack element;

FIG. 7 is a fragmented cross-sectional view of the rack assembly shown in FIG. 6, taken along line 7—7; and FIG. 8 is an exploded view of one of the locking arrangements formed on the rear and bottom walls of adjacent rack elements, showing the manner in which assembly is effected.

DESCRIPTION OF THE PREFERRED EMBODIMENT

Figure 1:
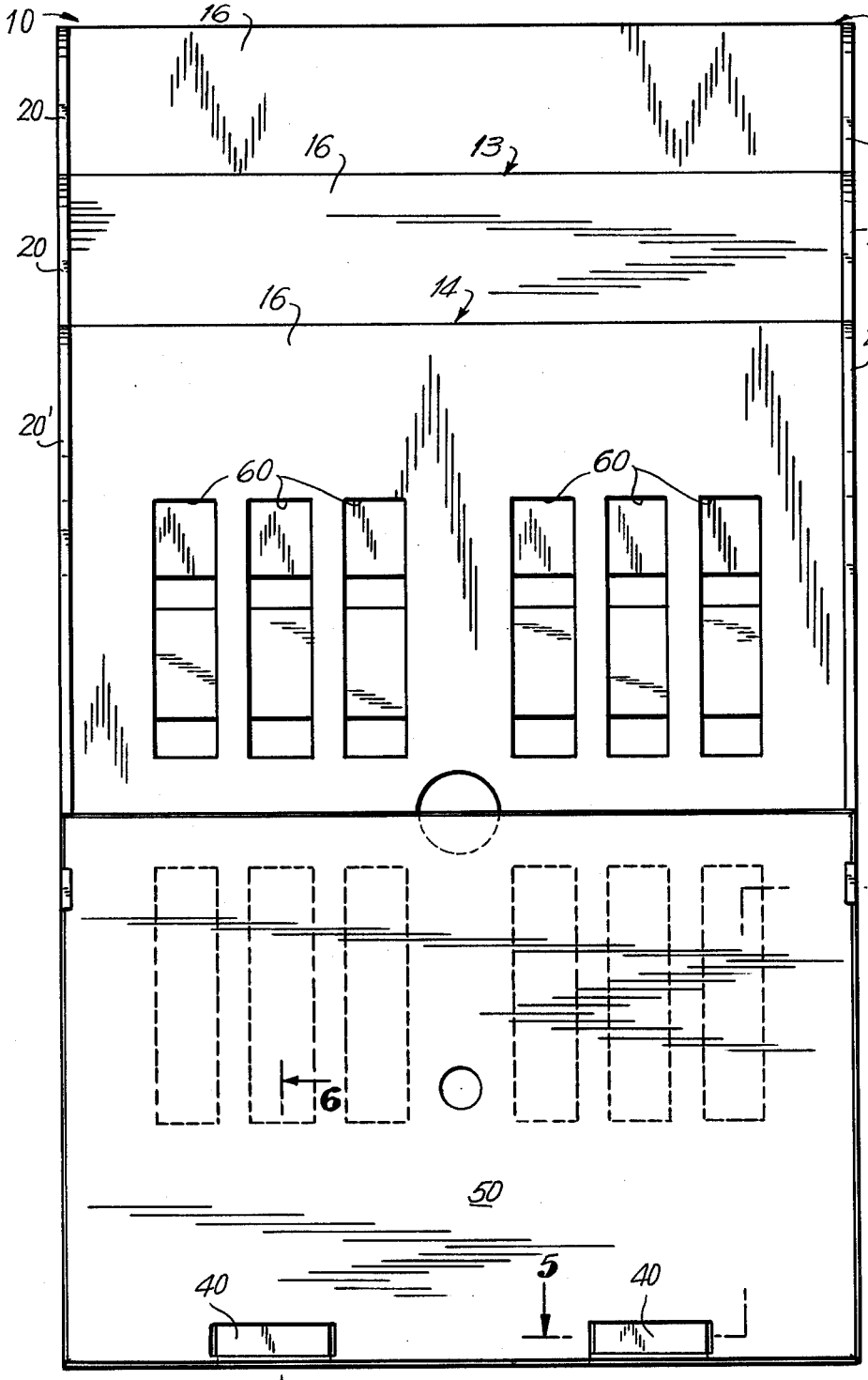
FIG. 1 is a front elevational view of an assembled rack assembly including three rack elements in accordance with the present invention.
Figure 2:
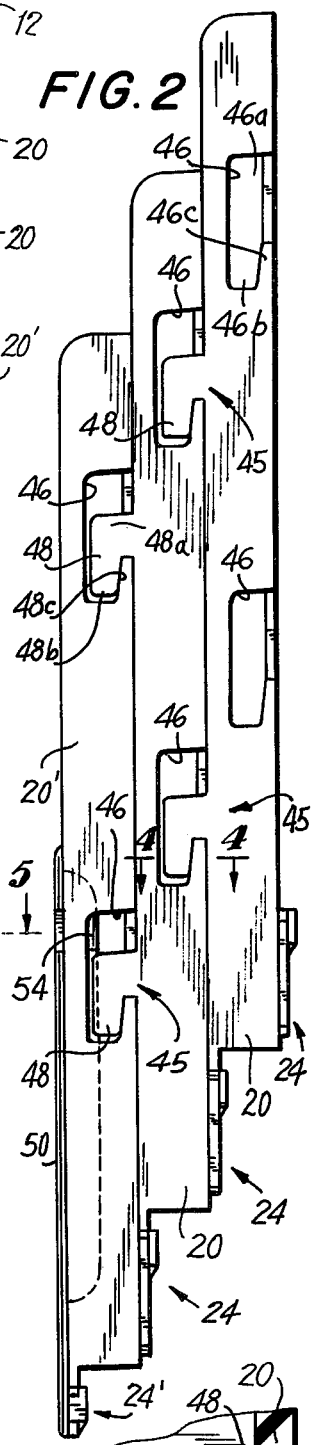
FIG. 2 is a side elevational view of the rack assembly shown in FIG. 1.
Figure 5:
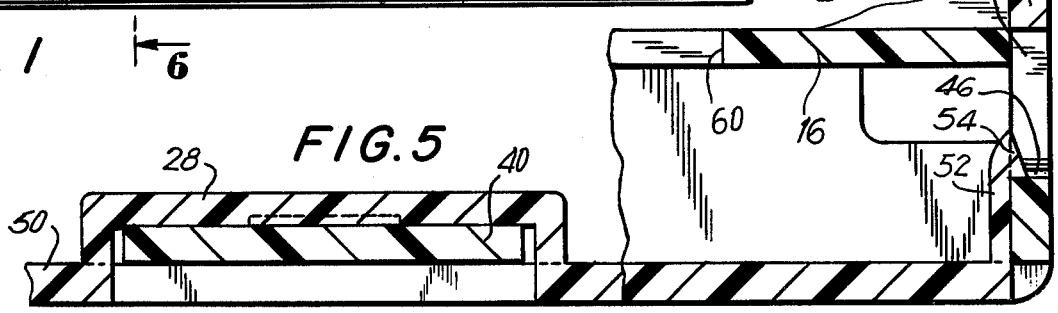
FIG. 5 is a fragmented cross-sectional view of the rack assembly shown in FIG. 1, taken along line 5—5.

Referring now specifically to the drawings, in which identical or similar parts are designated by the same reference numerals throughout, and first referring to FIGS. 1 and 2, the rack assembly 10 of the present invention includes a plurality of rack elements 12–14. While only three rack elements are shown, this is only for illustrative purposes and any number can be used as will become evident from the description that follows. Each of the rack elements is in the nature of a module which may be attached or connected to an adjacent module. The rack assembly 10 can thereby be sold in the disassembled condition thereof in kits of, for example, 10 or 20 rack elements. The facility with which the rack elements may be assembled permits such rack assemblies to be conveniently assembled in relatively short periods of time.

Each of the rack elements 12–14 is generally in the nature of a rectangular housing having a rear wall 16, a bottom wall 18 (best shown in FIG. 6), and a pair of side or lateral walls 20. The front-most rack element 14 has slightly modified side or lateral walls 20′ as will be more fully described hereafter.

When two or more rack elements are stacked together as shown in FIGS. 1 and 2, the rear wall of a frontwardly disposed rack element also serves as a front wall of the adjacent rearwardly disposed rack element to form a pocket 22, best shown in FIG. 6. Clearly, the dimensions of the pockets or bins 22 may be varied by a selection of dimensions for the rear walls 16, the bottom walls 18 and the side or lateral walls 20. The rack assembly 10 shown and described herein as the presently preferred embodiment has bins or pockets 22 having the depth of the bins substantially smaller than the heights or the transverse widths thereof. Such a rack assembly is particularly suitable for storing and displaying sheet music. However, as above suggested, changing the dimensions of the rear walls, bottom walls or lateral walls can modify the dimensions of the bins to accommodate any other product commonly displayed in this form. Thus, the rack assembly 10, possibly with minor changes in dimensions, can be utilized to store and display greeting cards, newsstand-type magazines, blank forms, or the like.

The rack assembly 10 is characterized in that the individual rack elements may be molded, such as from a plastic material. For example, the rack elements may be molded from styrene or other comparable plastics. It is desirable in selecting a material for the rack element that it be sufficiently stiff or rigid so that no additional reinforcing means need be provided even when the rack assembly includes upwardly of 20 rack elements. However, it is desirable that the material used for the rack elements have at least some resiliency, for reasons to be described below.

The rack assembly of the present invention is particularly characterized in that each of the rack elements is formed with two separate locking mechanisms, one of which cooperates with the rear walls 16 and the bottom walls 18 while the second locking mechanism corporates with the side walls 20. By integrally molding the locking mechanisms into the rack elements, a particularly simple and economical construction is obtained which permits easy and rapid assembly of the rack elements to each other while securely connecting these adjacent rack elements to each other.

The first locking mechanism to be described is generally designated by the reference numeral 24 in FIGS. 2 and 6–8. The first locking means or mechanisms 24 includes a first locking portion of the rear walls 16. The locking portion 26 is in the nature of an offset wall portion or a female connecting member 28 spaced from the plane of the rear wall 16 to form a slot 30 in the nature of a socket. As best shown in FIG. 6, the upper edge of the offset wall portion 28 is provided with a bevel 32, whose function will become apparent hereafter.

There may be additionally provided a supporting rib 34 which extends across the widths of each rear wall 16, is parallel to the bottom wall 18, and is generally coextensive with the upper edge of the offset wall portions 28. The function of the supporting rib 34 will similarly be more fully discussed below.

The second locking portion, which is in the nature of a male connecting member, is generally designated by the reference numeral 36. As best shown in FIGS. 6 and 8, the locking portion 36 depends or projects downwardly from the frontal region of the bottom wall 18. The second locking portion 36 generally includes a skirt 38 which extends across the entire width of the rear wall 16, as well as at least one tab or tongue 40 which is dimensioned to be received within the socket 30 of the female connecting member 26. The slot 30 is generally a rectangular slot and the tongue 40 has a generally rectangular cross-sectional configuration dimensioned to be received within the slot 30 with little clearance therebetween, as best shown in FIG. 6. Advantageously, the tongue 40 is provided at the lower end thereof with a wedge-shaped projection 42 which has a surface inclined rearwardly and upwardly from the lower edge of the tongue as shown, and an upper surface 44 generally disposed in a horizontal plane normal to the plane of the tongue or tab 40. As suggested above, the offset wall portion 28 is made of a resilient material and the projection 42 engages the offset wall portion 28 when the tongue is initially advanced through the slot 30 to resiliently deflect the wall portion 28 to enlarge the slot 30 and facilitate insertion of the tongue 40 therein. In this manner, the projection 42 snaps into a position disposed below the offset wall portion 28 subsequent to full insertion of the tongue 40 through the slot 30 to lock the same within the slot as a result of the abutment of the locking surface 44 with the lower edge of the offset wall portion 28.

When the tongue 40 is fully received within the slot 30 in the engaged condition of the male and female connecting members 26 and 36, the lower edge 45 of the skirt 38 abuts against or rests against the supporting rib 34. By supporting the next adjacent or rearwardly disposed rack element across the entire width thereof, the weights of the racks, as well as of the materials contained therein, are more evenly distributed across the entire widths of the rack elements instead of being concentrated only at the locations of the first locking mechanism 24. Such a construction therefore protects the offset wall portions 28 from experiencing deformations or stresses which may damage the same.

As best shown in FIGS. 2 and 6, the sockets 30 are disposed on the rear walls 16 at a height above the bottom walls 18 to correspond to the desired vertical displacement between adjacent racks. Clearly, the closer the offset wall portions 28 are to the bottom wall 18, the less the vertical displacement between adjacent racks while greater separation results in greater displacement. In the case of sheet music, wherein the title of the work appears proximate the upper edge thereof, it is only necessary to displace adjacent racks between approximately 2 and 3 inches. Where more exposure of the items is desired, clearly, greater vertical displacement between adjacent racks may be desirable. Additionally, as mentioned above, the rear wall 16 of a frontwardly disposed rack element in effect forms the front wall for a rearwardly disposed rack element. The extent to which an item within the pockets or bins 22 are exposed is, therefore, also a function of the heights of the rear walls 16. While the rear walls in the presently preferred embodiment have the same heights as the side walls, this is not essential and the rear walls 16 can clearly be made shorter to expose more of the items being displayed or higher than the side walls 20 to expose less of items.

While only one set of female and male members 26, 36 has been described in connection with FIGS. 6–8, it is clear that one or more sets of such connecting members may be provided to secure two adjacent rack elements. In the presently preferred embodiment, as suggested in FIG. 1, each rack element is provided with two female connecting members on the rear wall thereof, each of which is aligned and project downwardly from a common supporting rib 44. Similarly, each rack element is provided with two spaced tongues 40, each of which depends from a common lower edge 45 of a skirt 38. The offset wall portions 28 as well as the tongues 40 are positioned on the rack elements so that they are aligned with an associated mating member when the rack elements are aligned to bring the side walls of the two adjacent rack elements into common planes. At such time when alignment is achieved, the adjacent rack elements are moved vertically relative to each other to force the tongues 40 through the slots 30 and thereby move from an unengaged to an engaged condition. As should be evident, any number of male and female connecting members 36, 26 respectively may be used, so long as locking engagement is effected in all of them substantially at the same time since further relative movements of the adjacent or connected rack elements is prevented subsequent to engagement of any of the mating pairs.

The rack elements are further joined to each other by means of a second locking mechanism generally designated by the reference numeral 45 which is substantially formed in the planes of the side walls 20. The locking mechanisms 45 serve to connect the rack elements to each other as well as drawing adjacent rack elements together to dispose the same in close abutting relationship. This will be more fully discussed below. The first and second locking mechanisms 24, 45 are arranged to lock successively rearwardly disposed rack elements respectively successively upwardly to provide an upwardly and rearwardly stepped or terraced modular rack assembly 10.

The second locking mechanism 45 each includes at least one planar female opening 46 in the side walls 20 of each of the rack elements, and at least one planar male member 48 which projects forwardly from the side walls of the rack elements in the direction of the adjacent frontwardly disposed rack elements. The male planar members 48 are configurated and dimensioned to be receivable with associated female openings 46 in the planes of the side walls 20, as to be more fully described hereafter.

Each female opening 46 has a generally inverted L-shape which has a horizontal leg portion **46*a* thereof extending to the rear edge of a side wall 20 to provide access into the opening 46 from the direction of a rear wall 16. The opening 46 also has a vertical leg portion 46*b* which generally extends downwardly from the horizontal leg portion 46*a* and inwardly spaced from the rear wall 16 to form an upwardly projecting side wall extension 46*c*. In effect, each opening 46 is in the nature of an upper planar opening which is wider and opens to the rear of the rack element, and a lower planar opening, which has a height corresponding to that of the side wall extension 46*c***.

Each planar male connecting member 48 similarly has an inverted L-shape to correspond to the shape of the L-shaped opening 46 and projects forwardly from a side wall 20 to be receivable within an associated opening 48 of a forwardly disposed adjacent rack element. By projecting forwardly of the side walls 20 and subsequently projecting downwardly, the male members 48 each have a horizontal leg portion **48*a* and a vertical leg portion 48*b*. The vertical leg portion 48*b* is spaced from the side wall 20, and forms therewith a downwardly directed slot 48*c*. As best shown in FIG. 2, engagement of the planar female opening 46 and the planar male member 48 results when the planar male member 48 is lowered within the planar female opening 46 to bring the side wall extension 46*c* within the associated downwardly directed slot 48*c* to thereby effect locking. In effect, the side wall extensions 46*c* abut against the horizontal leg portions 48*a* of the planar male member 48 in the locked condition of the planar connector 45**.

The heights of the horizontal leg portions or upper opening portions **46*a* of the female openings 46 are greater than the heights of the male members 48. In this manner, the male members 48 may be initially received through the upper opening portions 46*a* at a first relative position of two associated adjacent rack elements in an unengaged condition thereof. After the planar male members 48 have been received into the upper opening portion 46*a* and positioned furwardly of the side wall extensions 46*c*, the rearwardly disposed rack element may be lowered relative to the frontwardly disposed rack element to bring the side wall extensions 46*c* within the spaces defined by the downwardly directed slots 48*c*. Simultaneously therewith, of course, the vertical leg portions 48*b* of the planar male members 48 are moved from the upper opening region 46*a* into the lower opening region 46*b* of the planar female openings 46**.

As best shown in FIG. 2, the vertical leg portions or lower opening portions of the planar openings 46 are wider than the corresponding vertical leg portions **48*b* of the planar male members 48. Advantageously, there is provided a downwardly and forwardly inclined edge or surface within each lower opening portion 46*b* to draw two adjacent rack elements together as the relative positions thereof change from the unengaged to the engaged conditions to lock the same in close abutting relation in the fully engaged conditions thereof. In the presently preferred embodiment, the forwardly disposed edges of the side wall extensions 46c as well as the rearward edge of the vertical leg portion 48b of the planar male member 48 are each inclined at a relatively small angle such as approximately 5°. Such a small incline affects the desired locking engagement as the adjacent rack elements are increasingly moved to the full engaged positions as shown in FIG. 2**.

As with the first locking mechanism 24 described above, one or more locking mechanisms 45 may be utilized. For example, it is possible to provide only one planar female opening 46 and a planar male member 48 in two co-planar side walls 20 of two adjacent rack elements. In the presently preferred embodiment, two locking mechanisms 45 are provided on each set of side walls 20. As shown, the locking mechanisms 45 are displaced in a vertical direction, the relative positions of the planar female openings 46 and the planar male members 48 being again selected to provide the desired vertical displacement between adjacent rack elements.

As best shown in FIGS. 3 and 4, there is further provided a guide tab or key 56 projecting from the front edge of each side wall 20 into the downwardly directed slot 48c which is dimensioned to be received within a guideway or keyway 58 formed in the side wall extension 46c. The key 56 and the keyway 58 ensure the proper alignment of the planar male member 48 within the planar female opening 46 to dispose these mating parts within the planes of the side walls 20. Such a construction initially guides the rack elements relative to each other to assure reliable interconnection of the rack elements to each other by means of the locking mechanisms 45.

Referring to FIGS. 1, 2 and 6, it will be noted that the front-most rack element 14 differs slightly from the rearwardly disposed rack elements 12 and 13 in that the rack element 14 is not provided with forwardly projecting planar male members 48. In the presently preferred embodiment, a cover plate 50 is provided which is connected to the front-most rack element 14 to form a bin or pocket with the side walls 20' and the rear wall 16 of the rack element 14. The height of the cover plate 50 is not critical although it is shown to have a height of approximately one-half that of the rear walls 16 to expose to a greater extent the items within the front-most bin. Clearly, the front cover plate 50 may have a greater height if desired to only expose a comparable portion of the items therein as are exposed in the rearwardly disposed bins or pockets.

The cover plate 50 is provided at the lower edge thereof and projecting from the rearward surface thereof with a female connecting member 26 similar to those used on the rear walls 16 of the rack elements. Accordingly, the lower edge of the cover plate 50 may be connected or engaged with the tongues 40 downwardly projecting from the front-most rack element 14 as shown in FIGS. 2 and 6.

The cover plate 50 has a pair of rearwardly projecting alignment walls 52 which are parallel to each other and spaced inwardly of the side walls 20' of the front-most rack element 14. The alignment walls 52 are provided at the upper ends thereof with wedge-shaped projections 54 extending outwardly to be snappingly engaged within a planar female opening 46 of the front-most rack element 14. Accordingly, it will be noted in FIG. 2 that the planar female opening 46 in the front-most rack element 14 receives both a planar male members 48 of the next successive rack element 14, as well as the wedge-shaped projections 54 of the cover plate 50.

While the provisions of a cover plate 50 results in a finished and aesthetically pleasing appearance, the present invention also contemplates the use of only rack elements having frontwardly projecting planar male members 48, such as rack elements 12 and 13. In that case, the first bin 22 is formed behind the rear wall of the front-most rack element. However, the presently preferred embodiment contemplates the use of the modified front-most rack element 14 without the frontwardly projecting planar male members 48 and the use of a front cover plate 50 in association with such a front-most rack element.

The rear walls 16 are advantageously provided with an array of openings 60 during the molding process. This serves both to save material as well as result in a more light-weight construction.

What has been described above is a simple and economical rack assembly whose rack elements may be molded from any suitable plastic material and which have two separate and independent locking mechanisms, one of which is associated with the rear walls and bottom walls of the rack elements while the other locking mechanism is co-planar with the side walls thereof. The locking mechanisms are advantageously integrally formed with the rack elements so that additional hardware is not required for the assembly of the rack elements which are in the form of modules which may be interconnected to form a terraced rack display of any desired size.

It is to be understood that the foregoing description of the embodiment illustrated herein is exemplary rather than limiting in nature and various modifications to the embodiment as shown herein may be made without departing from the spirit and scope of the invention.

What is claimed is:

1. A rack assembly comprising a pluarality of rack elements connectable to each other to form a terraced rack display, each rack element generally being in the nature of a rectangular housing having bottom, rear and side walls, each element having first locking means including a receiving first locking portion substantially in the plane of said rear wall and forming on upwardly open socket and a second locking portion connected to and downwardly projecting from the frontal region of said bottom wall between said side walls, a first locking portion of a frontwardly disposed rack element being adapted to receive a downwardly projecting second locking portion of an adjacent rearwardly disposed rack element to thereby permit adjacent rack elements to be fixedly connected to one another, said rack elements further having second locking means substantially in the planes of said side walls for aligning adjacent rack elements with one another and for securely fixing the positions of the connected rack elements relative to one another, said first and second locking means being arranged to lock successively rearwardly disposed rack elements respectively successively upwardly to provide an upwardly and rearwardly stepped or terraced modular rack assembly.

2. A rack assembly as defined in claim 1, wherein said first and second locking portions are spaced from each other in the direction of the plane of said rear wall a distance to substantially correspond to the desired vertical displacement between adjacent rack elements.

3. A rack assembly as defined in claim 2, wherein a rear wall of a frontwardly disposed rack element forms a front wall of an adjacent rearwardly disposed rack element when said rack elements are connected, said rear walls having a height selected to expose desired upper portions of items placed within said rack elements.

4. A rack assembly as defined in claim 1, wherein said first and second locking portions are snappingly engageable with one another.

5. A rack assembly as defined in claim 1, wherein one of said locking portions is a male connecting member and the other of said locking portions is a mating female connecting member.

6. A rack assembly as defined in claim 5, wherein said first locking portion is at least one socket and said second locking portion is at least one tongue dimensioned to be received within said at least one socket.

7. A rack assembly as defined in claim 6, wherein said socket is in the form of an offset wall portion in said rear wall for forming a generally rectangular slot, and said tongue has a rectangular cross-sectional configuration dimensioned to be received within said slot with little clearance therebetween.

8. A rack assembly as defined in claim 7, wherein said offset wall portion is made of a resilient material and is provided with an upper edge beveled in the direction of said rear wall, said tongue being formed with a wedge-shaped projection engageable with said offset wall portion bevel when said tongue is received within said slot, whereby said wedge-shaped projection initially resiliently deflects said offset wall portion to enlarge said slot and facilitate insertion of said tongue therein, said wedge-shaped projection snapping to a position below said offset wall portion upon full insertion of said tongue to lock the same within said slot.

9. A rack assembly as defined in claim 6, wherein two tongues and two mating sockets are provided on each rack element.

10. A rack assembly comprising a plurality of rack elements connectable to each other to form a terraced display, each rack element generally being in the nature of a rectangular housing having bottom, rear and side walls, each element having first locking means including a first locking portion substantially in the plane of said rear wall and a second locking portion downwardly projecting from the frontal region of said bottom wall, a first locking portion of a frontwardly disposed rack element being engageable with a second locking portion of an adjacent rearwardly disposed rack element to thereby permit adjacent rack elements to be fixedly connected to one another, said rack elements further having second locking means substantially in the planes of said side walls for aligning adjacent rack elements with one another and for securely fixing the positions of the connected rack elements relative to one another, said second locking means comprising at least one planar female opening in said side walls of each of said rack elements, and at least one planar male member projecting forwardly from said side walls of said rack elements which are rearwardly disposed behind adjacent rack elements, said male members being configurated and dimensioned to be receivable within associated female openings in the planes of said side walls; said first and second locking means being arranged to lock successively rearwardly disposed rack elements respectively successively upwardly to provide an upwardly and rearwardly stepped or terraced modular rack assembly.

11. A rack assembly as defined in claim 10, wherein female openings and male members are provided on both side walls of each rack element.

12. A rack assembly as defined in claim 10, wherein two female openings and male members are provided on each side wall of each rack element.

13. A rack assembly as defined in claim 10, wherein each female opening has a generally inverted L-shape with a horizontal leg portion thereof extending to the rear edge of a side wall to provide access into said opening from the direction of said rear wall, the vertical leg portion of each female opening being generally downwardly directed and inwardly spaced from said rear wall to form an upwardly projecting side wall extension, and each male member having said inverted L-shape to correspond to the shape of said L-shaped opening to define with an associated side wall a downwardly directly slot and projecting forwardly from said side walls to be receivable within the associated opening of a forwardly disposed adjacent rack element with said side wall extensions being received within said downwardly directed slots to effect locking.

14. A rack assembly as defined in claim 13, wherein the heights of said horizontal leg portions of said female openings are greater than the heights of said male members, whereby said male members may be initially received through said opening horizontal leg portions at one relative position of two associated adjacent rack elements in an unengaged condition thereof and subsequently moved into said opening vertical leg portions to the engaged condition thereof.

15. A rack assembly as defined in claim 14, wherein said vertical leg portions of said openings are wider than said vertical leg portions of said male members, and wherein a downwardly and forwardly inclined edge is provided within each open vertical leg portion to increasingly draw two adjacent rack elements together as the relative positions thereof change from the unengaged to the engaged conditions to lock the same in close abutting relation in the fully engaged conditions thereof.

16. A rack assembly as defined in claim 10, wherein the front-most rack element in the assembly only has female openings in said second locking means matable with male members in a rearwardly disposed rack element.

17. A rack assembly as defined in claim 16, further comprising a front cover plate connectable to the front-most rack element, said cover plate having first locking portions similar to those of said first locking means engageable with said second locking portions of the front-most rack element, and having a pair of alignment walls spaced inwardly of said front-most side walls; said alignment walls having wedge shaped projections extending outwardly to be snappingly receivable within said planar female openings of said front-most rack element.

18. A rack assembly as defined in claim 17, wherein said cover plate has a height substantially smaller than that of said rear wall.

19. A rack assembly as defined in claim 1, wherein the depths of said rack elements are substantially smaller than the heights and widths thereof, to permit the stacking of a large number of rack elements, suitable for storing and displaying sheet music and the like, within a rack assembly which has an overall height substantially greater than the overall depth thereof.

20. A rack assembly as defined in claim 10, further comprising guideway and key means associated with each pair of planar female opening and male member for aligning the same in a common plane to assure secure locking therebetween in the engaged condition thereof.

* * * * *